US006588706B1

(12) United States Patent
Jaquez

(10) Patent No.: US 6,588,706 B1
(45) Date of Patent: Jul. 8, 2003

(54) LAUNCHABLE PAPER KITE

(76) Inventor: Ramiro Jaquez, 1692 Burley Dr., Milpitas, CA (US) 95035

( * ) Notice: Subject to any disclaimer, the term of this patent is extended or adjusted under 35 U.S.C. 154(b) by 0 days.

(21) Appl. No.: 09/211,325

(22) Filed: Dec. 15, 1998

(51) Int. Cl.[7] ..... A63H 27/08; B64C 31/06; F41J 9/08

(52) U.S. Cl. ..... 244/153 R

(58) Field of Search ..... 244/153 R, 154, 244/155; 446/61, 62, 67, 68; D21/438, 445, 439; D22/125; 43/3, 2

*Primary Examiner*—Charles T. Jordan
*Assistant Examiner*—Judith A. Nelson

(74) *Attorney, Agent, or Firm*—Robert Samuel Smith

(57) ABSTRACT

A kite which in a simplest embodiment comprises a central rectangular section having one edge joined to an edge of one rectangular side section and an opposite edge joined to an edge of an opposite side section wherein, reach edge to edge junction has a tube secured to the sheet along a junction line. Each of four corners of the kite are secured to one of four cords respectively, permitting a user to maneuver the kite while the kite is in flight. The use of tubes permits joining one such kite, to another, by inserting one end of a rod into one tube of one kite and another end of the rod into a tube of another kite such that the central sections of the kites are coplanar and each side section of each module is coplanar with a side section of the other kite respectively. Use of tubes to construct the frame provides strength and light weight to the kite construction.

9 Claims, 6 Drawing Sheets

LAUNCHABLE PAPER KITE

FIELD OF THE INVENTION

This kite relates to stunt kites and particularly to a kite that can be assembled in several configurations, is launchable with only one operator, can perform controlled stunts, and can be constructed as a very small kite or a very large kite.

BACKGROUND OF THE INVENTION

Mankind's fascination with things that fly was first manifested by the development of the kite. These manifestations continue to appear in different forms.

For example, kites are constructed to resemble birds or as boxes. Two or more cords of attachment are applied to the kite to perform "stunts" such as diving, and turning. Kites have been developed to engage in "kite fights" with other kites in which one kite flier attempts to maneuver his kite so as to cut the string of his opponent's kite.

U.S. Pat. No. 4,799,634 to Bezulieu discloses a kite with means for dropping a parachute.

U.S. Pat. No. 5,322,247 to Munday et al discloses a kite having a sail shape and four cords attached to the kite for causing the kite to travel and turn in any direction.

U.S. Pat. No. 5,328,134 to Powers discloses a kite having a delta frame with dual control lines and quad control lines.

U.S. Pat. No. 5,556,057 to Davis discloses a kite which changes geometry and aerodynamic form in flight and has a flexible leading edge spar.

The present invention introduces the idea of a kite that has features that parallel the present active interest in space stations.

SUMMARY OF THE INVENTION

It is an object of this invention to provide a kite that has a modular construction, each module being capable of flight. It is another object to use materials that are very economical and lightweight so that very small kites can be constructed. It is a further object that the kite be adaptable to added features such as great maneuverability and the ability to carry objects aloft and which are then released.

This invention is directed toward a kite whose frame is constructed of paper or plastic tubes, such as drinking straws. The straws are joined by any one of several ways. They may be joined end to end by inserting the crimped end of one tube into the uncrimped end of another tube. Or they may be joined end to end by having the end of each tube telescope into a short tube section having an axial slit in one side permitting the section to expand to permit insertion of the tubes to be joined.

The frame is constructed with light weight paper or plastic tube which permits construction of various kite constructions according to the imagination of the kite flier.

DETAILED DESCRIPTION OF THE DRAWINGS

Figure 1:
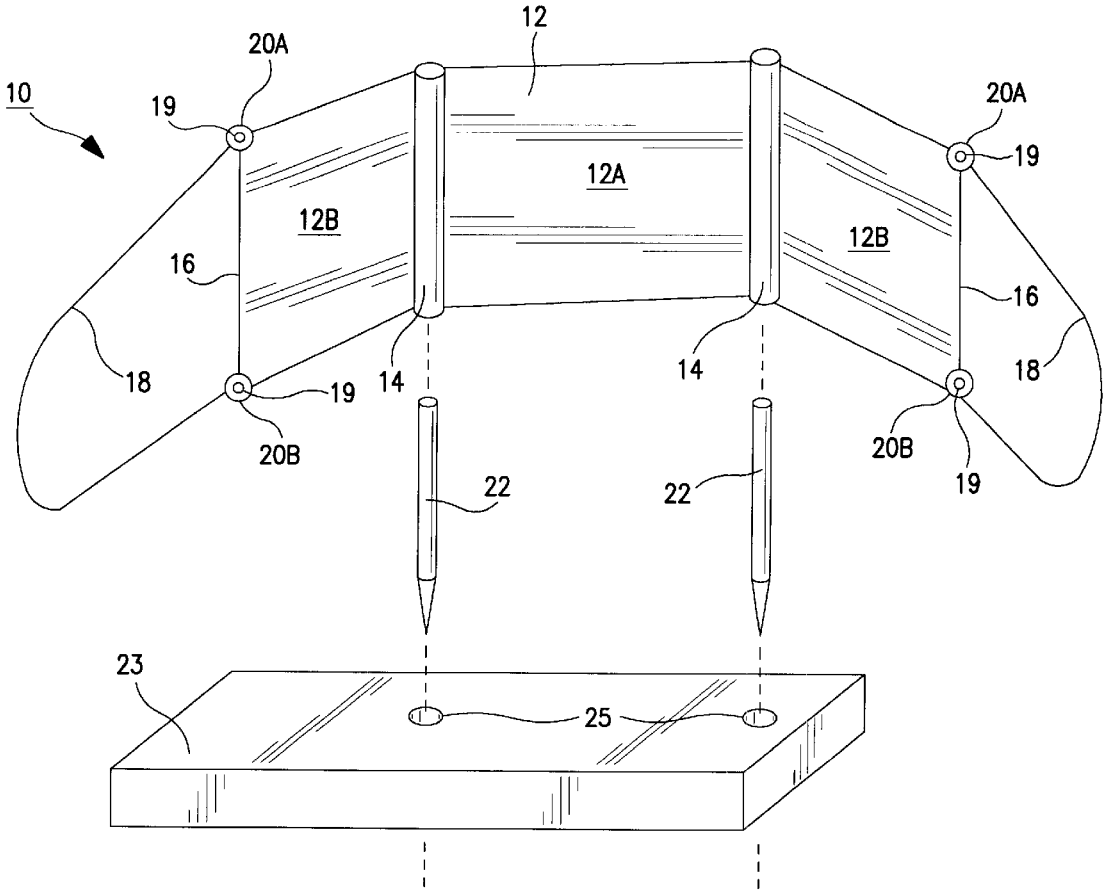
FIG. 1 shows the basic kite module of this invention.

Turning now to a discussion of the drawings, FIG. 1 shows a basic kite module 10 of this invention. There are shown a substantially rectangular sheet 12 of light material, such as paper or light plastic. Two "hinge" tubes 14 are shown spaced parallel to one another and to a pair of outside edges 16 of the sheet 12. Each "hinge" tube 14 is secured along most of its length to the sheet 12 as by gluing thereby defining a central section 12A of said kite and two side sections 12B. The "hinge" tubes 14 are light weight paper or plastic, and for many sizes of kites of this invention, may be drinking straws. The kite is controlled by a pair of cord loops 18 . Each cord loop 18 has one end secured to a corner 20A of the sheet 12 on one end of outside edge 16 and another end secured to another end of outside edge 16, so that each of the four corners (20A and 20B) of the sheet are secured to an end of one of the loops.

The end of the cord is attached to the respective corner of the sheet by looping through a hole in the corner of the sheet, the hole being reinforced by a reinforcement paper ring 19 such as are applied to sheets in the well known loose leaf notebooks.

A block 23 and pair of rods 22 are provided which is the "launching pad" of the kite. In order to launch the kite, the two rods 22 are inserted into two holes 25 side by side in block 23 and spaced from one another at a distance to provide that the kite may be supported upright by telescoping the lower ends of the hinge tubes 14 onto the ends of rods 22. The user, standing at a distance from the rods and holding onto the loops, pulls the loops 18 or runs from the kite 10 creating a wind drag that launches the kite into the air. The "launch" feature of this invention provides that the user can launch the kite by himself without the need for a partner to hold the kite erect while he pulls the loops (cord attached to the kite). In an alternative arrangement, the rods are inserted into the ground instead of into the block preparatory to mounting the kite onto the rods.

Figure 2:
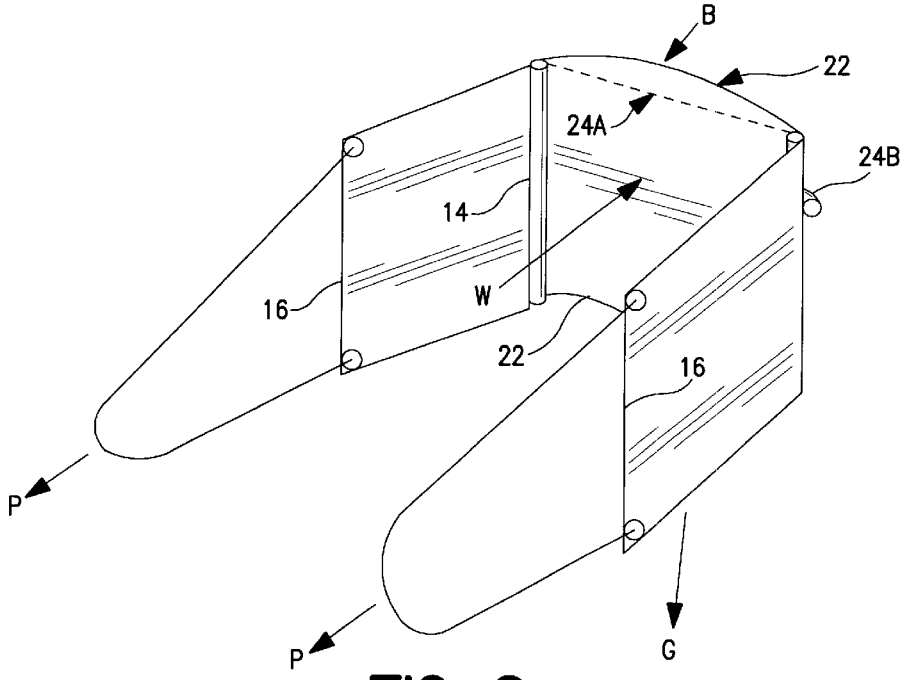
FIG. 2 shows the kite of FIG. 1 and illustrating forces exerted on the kite.

FIG. 2 illustrates the forces acting on the kite in flight. One of the forces is the force (arrow P) of the loops (cords)18 pulling toward the user. The second force is the force of gravity (arrow G)pulling the kite downward. The third force is the force (arrow W) of the wind against the kite which counteracts both the force from the cords and gravity. The combination of forces tends to force the edges 16 of the kite to fold toward one another.

The amount of folding, illustrated in FIG. 2 by the bow B of the edge 23 of the flying kite, is a balance of the stiffness of the sheet and the summation of forces on the kite. The amount of bowing can be reduced or substantially eliminated by one or more creases 24 in the sheet 12 perpendicular to edges 16. Alternatively, the creases 24A may be replaced by "reinforcing" tubes 24B.

Figure 3:
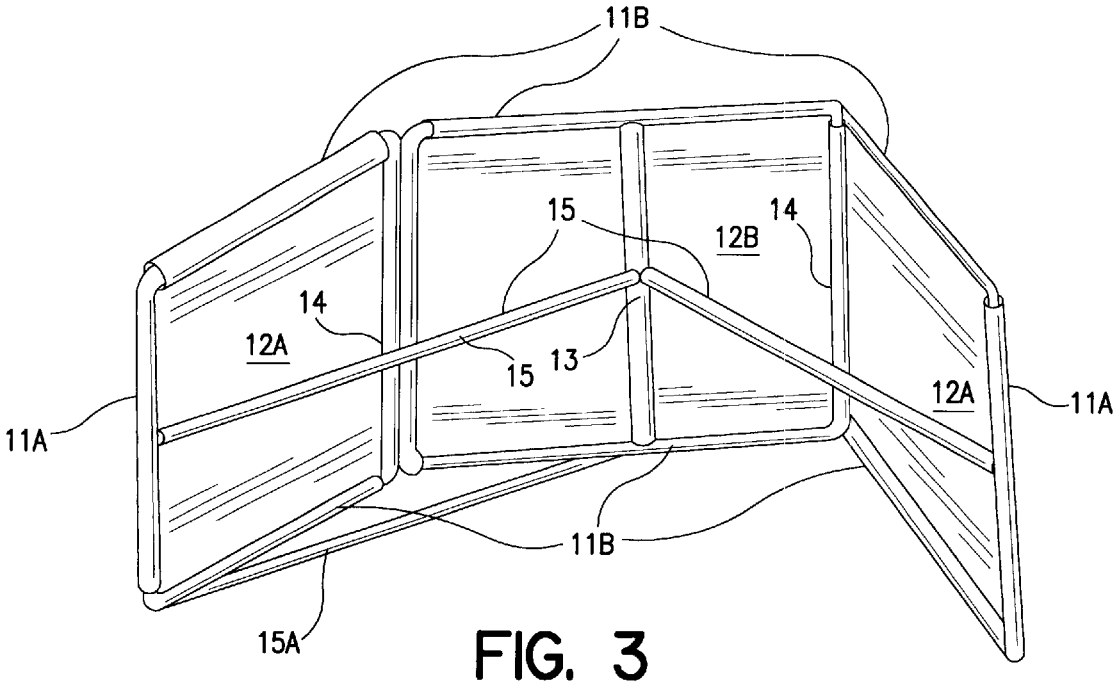
FIG. 3 shows the kite with additional supports.

FIG. 3 is a perspective view showing additional "border" tubes 11A and 11B added along the borders of the sheet 12 and a "center" tube 13 along the centerline of the sheet 12. These additional tubes provide that larger kites can be used and/or the sheet may be a lighter material such as cellophane or thinner paper, and still maintain the shape of the kite against the forces acting on the kite.

FIG. 3 also shows a pair of "strut" tubes 15, each "strut" tube 15 having one end secured to the "center" tube 13 and another end secured to the "border" tubes 11A of FIG. 4.

Figure 4A:
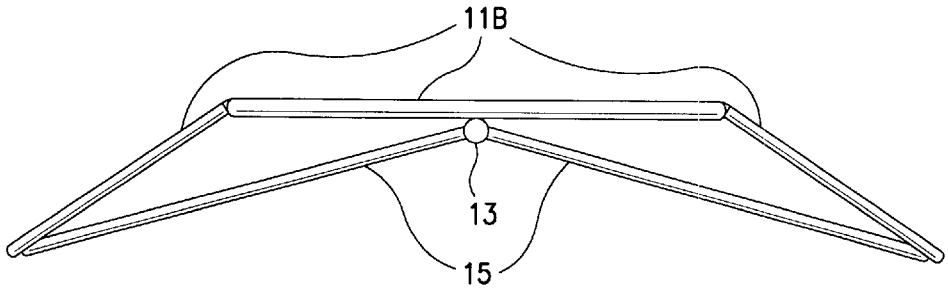
FIG. 4A shows a side view of the kite of FIG. 3.

FIG. 4A is a side view of FIG. 3 showing that the strut tubes support the outer sections 12B of sheet 12 at a selected angle relative to central sheet section 12A.

Figure 4B:
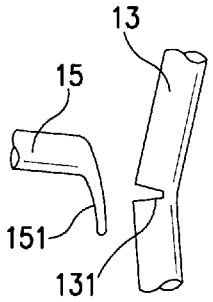
FIG. 4B is a disassembled view of the joint of a strut tube with border tube.
Figure 4C:
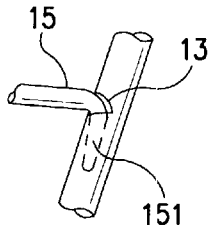
FIG. 4C is an assembled view of the joint of a strut tube with border tube.

FIGS. 4B and 4C show to greater advanage the details of a joint such as the union of the end of strut tube 15 secured to the side of tube 13 at a location between the ends of tube 13. There are shown in FIG. 4B tube 15 (cutaway) with crimped and bent end 151 proximal to tube 13 having slit 131. FIG. 4C shows the crimped end 151 (in phantom) inserted through the slit 131 in tube 13 thereby securing the end of tube 15 to a middle location of tube 13 as shown in FIG. 3.

The construction of the kite frame using tubes is adaptable to forming a "modular" kite by joining several individual kites together.

Figure 5A:
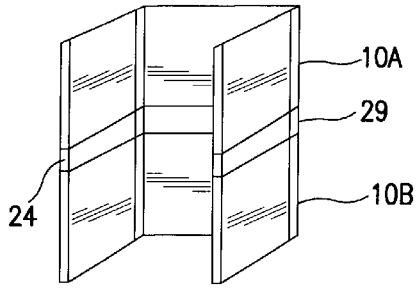
FIG. 5A shows the bottom of one kite module joined to the top of another kite module.

For example, FIG. 5A shows two "modules", 10A, and 10B, joined by aligning and securing ends of hinge tubes 14 and border tubes 11A of one kite module 10A to ends of hinge tubes 14 of a second module 10B by short rods 29 (or crimped tubes) inserted into respective ends of joined tubes.

Figure 5B:
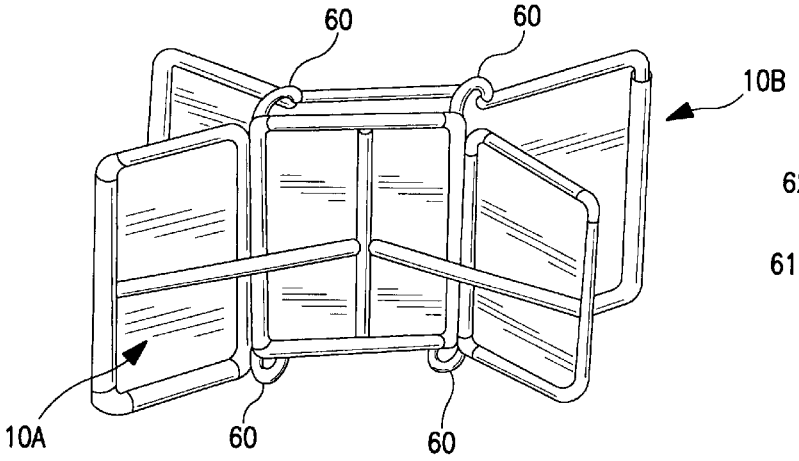
FIG. 5B shows two kite modules joined back to back.

FIG. 5B shows kite module 11A joined back to back to kite module 10B. The two kite modules are joined using four couplers 60.

Figure 5D:
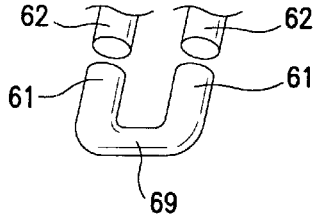
FIG. 5D shows a union for joining modules
Figure 5C:
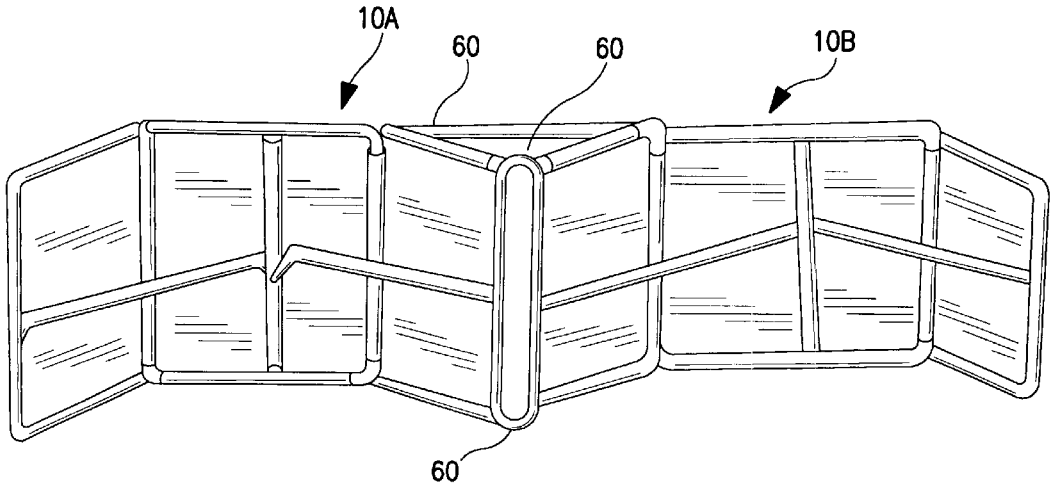
FIG. 5C shows two kite modules joined side by side.

FIG. 5C shows kite module 10A joined to module 10B side by side using U coupling 60 having junction legs 61

FIG. 5D shows the coupler 60 in more detail. Couple 60 is is a U-tube having two crimped side legs 61 so that each leg of the U-tube coupling 60 can be inserted into an open end of neighboring tubes 62. The joining leg 69 as shown in coupling 60 or long as shown in coupling 66 (FIG. 5C)

Figure 6:
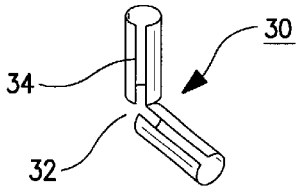
FIG. 6 shows one type of coupling.

FIG. 6 shows a section of tube cut to form a "union" 30 for joining tubes. Union 30 has a (partial) circumferential cut 32 and a n axial cut 34.

Figure 7:
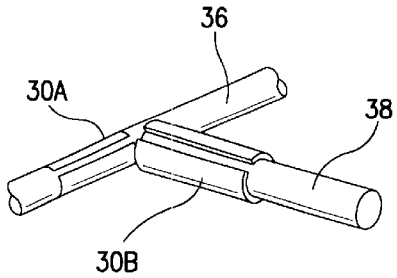
FIG. 7 shows the coupling of FIG. 6 joining a pair of tubes.

FIG. 7 shows tube 36 joined to tube 38 by union 30. One section 30A of union 30 encloses tube 36 and the other section 30B encloses tube 38. An adhesive (glue) on the inside of union 30 ensures that tube 36 and is secured to tube 38.

Figure 8A:
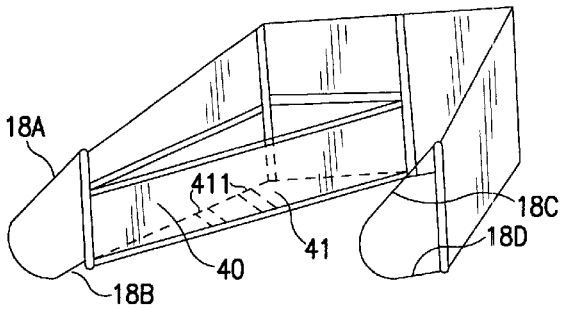
FIG. 8A shows a kite module with a nest for carrying objects such as a parachute.

The paper or plastic tubes used in the construction of the frame are also used in other functions related to the sport of kite flying. For example, FIG. 8A shows a "nest" having a front panel 40 and a floor 41 (floor 41 shown in Phantom in FIG. 8A). The nest holds an object, e.g., a parachute, that is released by pulling the appropriate control cord 18A–D, to turn the kite over to dump the contents of the nest.

Figure 8B:
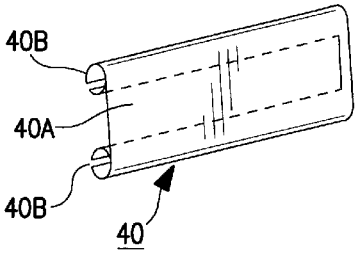
FIG. 8B shows details of a removable panel for a nest.

FIG. 8B shows details of the front panel which is detachable from struts 15 and 15A. (Struts 15 and 15A are shown in FIG. 3). Front panel 40 includes a rectangular sheet 40A having two parallel edges joined to a pair of split tubes 40B. Each tube "snaps" around one of struts 15 and 15A respectively so that the panel 40 is removable if desired.

Figure 8C:
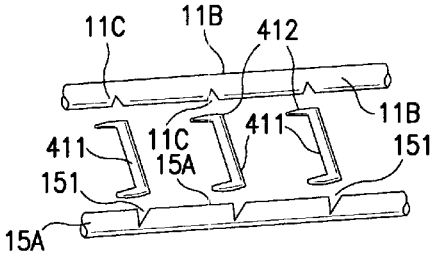
FIG. 8C shows details of a floor for a nest.

FIG. 8C is an exploded view showing details of the floor 41 of the nest shown in FIG. 8A.

Figure 8D:
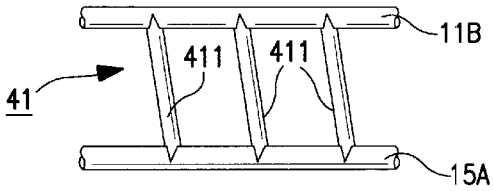
FIG. 8D shows an assembled view of the floor of the nest.

FIG. 8D shows the assembled floor 41 of the nest shown in FIG. 8A. Floor 41 comprises three "floor" tubes 411, each floor tube having crimped and bent ends 412. For each floor tube 411, "border" tube 11B has a notch 11*c* and each bottom strut 15A has a corresponding notch 151. Each crimped bent end 412 of each floor tube 411 slides into either of notches 11C and 151 so as to form the floor (in phantom) 411 shown in FIG. 8A.

Figure 8E:
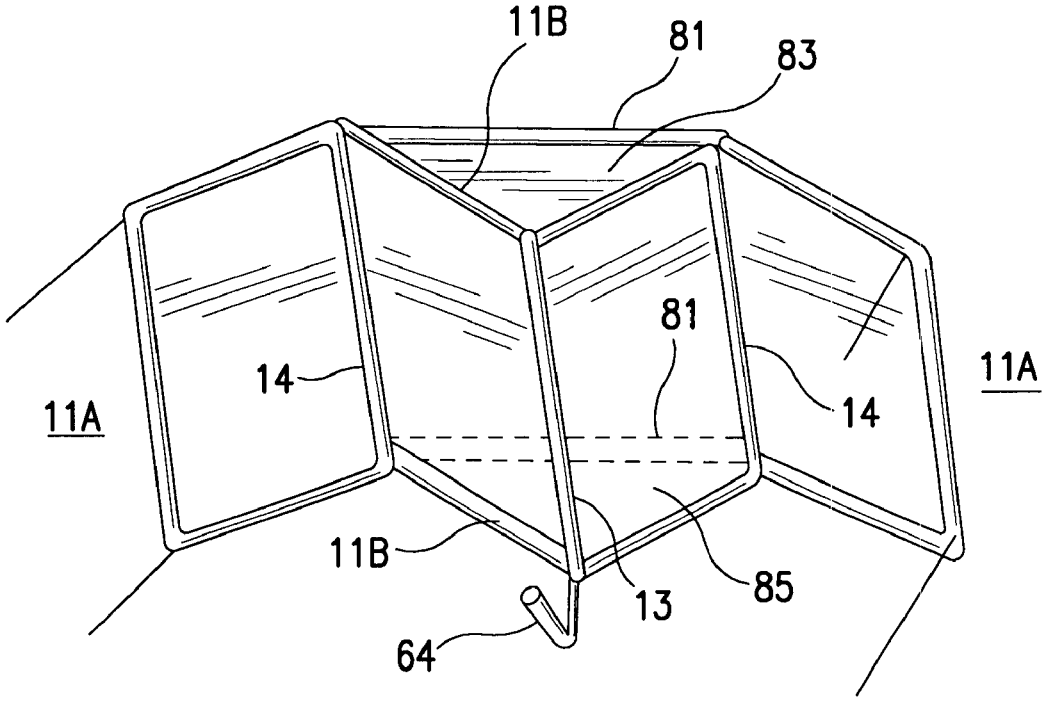
FIG. 8E shows a kite with a pouch on the back side of the kite.

FIG. 8E is a perspective view of a kite similar to the kite of FIG. 8A except that the pouch 83 is on the back of the kite, opposite the flier. The border tubes 11B are bent around center tube 13 and strut tubes 81 and are secured to hinge tubes 14 on the back of the kite. The back panel 14 and floor 85 (in phantom) are shown.

FIG. 8E also shows a hook 64 attached to the bottom edge of the kite. The hook 64 enables the flier to perform another stunt with the kite which is to maneuver the kite to pick up small objects such as a paper bucket and transfer the object to another location.

Variations and modifications of the invention may be suggested by reading the specification and studying the drawings which are within the scope of the invention. For example, paper or plastic tubes are commonly available in two sizes. One size is about ¼ inch diameter and is the common drinking straw. Another size is about 1/16 inch diameter and is used as a stirrer. The smaller the size tube is especially adaptable to making very small kites of this invention. The cords for such kites are preferably fine nylon cords sold in the United States under the trade name Omniflex™. These very small kites are flyable using a domestic wind fan to generate the wind.

Figure 9A:
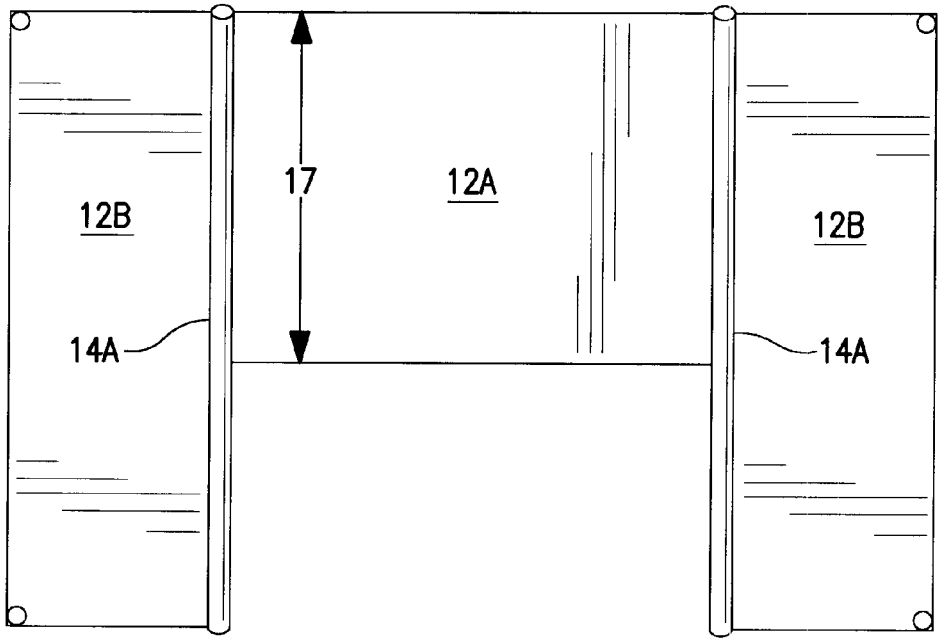
FIG. 9A shows a kite having extended side sections.
Figure 9B:
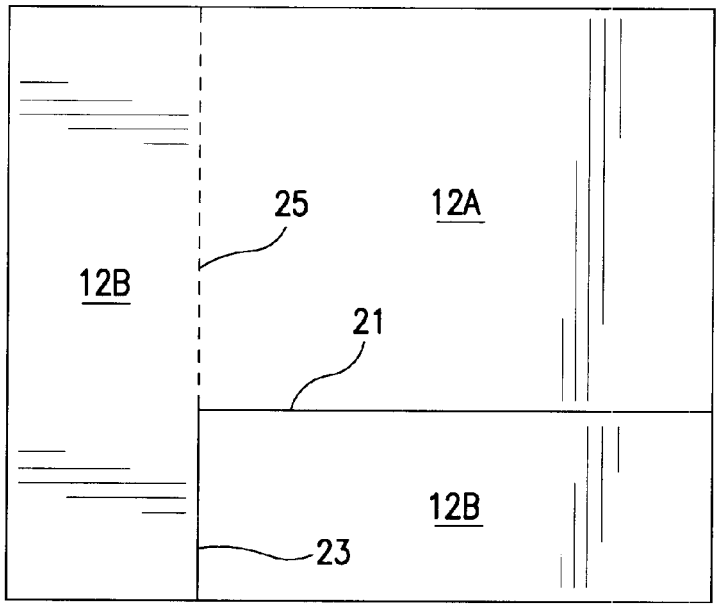
FIG. 9B shows a paper pattern of FIG. 9A.

As another example, FIG. 9A show a kite module of this invention in which the side sections, 12B have a longer edge 14A than the length 17 of central section 12A. The sheet for this module can be prepared as shown in FIG. 9B by folding along line 25 a sheet (e.g., an 8½×11 inch sheet along lines 21 and 23 so as to provide a side section 12B which is attachable to the central section 12A opposite the other side section 12B. An advantage of the configuration which extended side sections shown in FIGS. 9A–B is that the kite flier is able to readily determine that his kite is flying "right side up".

In view of these contemplations, I therefore wish to define the scope of my invention by the appended claims.

I claim:

1. A kite comprising:

a sheet (12), substantially rectangular, having a length dimension and a width dimension;

a pair of hinge tubes, each hinge tube (14) secured to said sheet (12) along said width dimension parallel to and spaced from said other hinge tube (14) providing that a central section (12A) and two side sections (12B) are defined;

each side section having a free boundary (16) opposite a boundary secured to said respective hinging tube (14) and opposite a free boundary of said other said side section;

a pair of cords (18), each cord having means (19) for attaching one end of said cord to one corner of said sheet at one end of one of said free boundaries and for attaching another end of said each cord to an opposite end of said one of said free boundaries providing that said pair of cords forms a pair of loop arrangeable to permit a user to hold onto said pair of loops when said kite is in flight;

at least one border tube (11) secured to said sheet and disposed along at least one of borders of said side and central sections;

means for connecting an end of any one of said tubes to any location on a neighboring tube being a connecting tube having a length substantially shorter than said any one of said tubes and said neighboring tube;

said connecting tube having a slit in the axial direction from one end to another end;

a circumferential slit extending partially around a periphery of said connecting tube defining two portions (30A, 30B) of said connecting tube providing that each portion of said connecting tube is one of:

(i) clampable around one of said support tubes;

(ii) collapsibly insertable into an open end of one of said support tubes.

2. The kite of claim 1 wherein said sheet is a material selected from a group of materials that consists of paper and plastic.

3. The kite of claim 1 further comprising means for supporting said kite in an an upright position preparatory to launching said kite.

4. The kite of claim 3 wherein said means for supporting comprises:

a pair of rods;

each one of said pair of rods (22) having one end insertable into ground and another end insertable into an open end of one of said hinging tubes operably arranged to support said kite in an upright position from whence said kite is launchable by pulling on said cords.

5. The kite of claim 1 which comprises at least one of:

(i) at least one crease;

(ii) at least one reinforcing tube;

attached to said kite in an operable arrangement to prevent bowing of at least one of said side section and said central section of said sheet along said length dimension.

6. The kite of claim 1 wherein said free boundary of each said side section is longer than a boundary between each said side section and said central section.

7. The kite of claim 1 further comprising a hook means secured to a bottom edge of said kite and arranged in operable combination with said kite for transorting objects.

8. A kite comprising:

a sheet (12), substantially rectangular, having a length dimension and a width dimension;

a pair of hinge tubes, each hinge tube (14) secured to said sheet (12) along said width dimension parallel to and spaced from said other hinge tube (14) providing that a central section (12A) and two side sections (12B) are defined;

each side section having a free boundary (16) opposite a boundary secured to said respective hinging tube (14) and opposite a free boundary of said other said side section;

a pair of cords (18), each cord having means (19) for attaching one end of said cord to one corner of said sheet at one end of one of said free boundaries and for attaching another end of said each cord to an opposite end of said one of said free boundaries providing that said pair of cords forms a pair of loop arrangeable to permit a user to hold onto said pair of loops when said kite is in flight;

at least one border tube (11) secured to said sheet and disposed along at least one of borders of said side and central sections;

at least one support tube secured to said sheet and having one end secured perpendicularly to and between ends of one of said border tubes and a closest one of said border tubes;

a central support tube (13) secured to said central section (12A) parallel to said end sections and said kite;

a first strut tube (15);

means for attaching one end of said first strut tube to said central support tube intermediate ends of said central support tube and attaching another end of said strut tube to a border tube along an outside edge of one of said side sections;

second strut tube;

means for attaching one end of said second strut tube to said central support tube adjacent one end of said central support tube and attaching another end of said strut tube to a border tube along an outside edge of one of said side sections on an end of said border tube closest to said one end of said central support tube;

a panel;

means for securing one edge of said panel to said first strut tube and an opposite edge of said panel to said second strut tube whereby a nest space is defined bounded by said panel, a portion of said central section and a portion of said one of said side sections;

a floor operably arranged with said panel, a portion of said central section and a portion of said one of said side sections to form a nest permitting objects placed in said nest to be carried by said kite.

9. A kite comprising:

a sheet (12), substantially rectangular, having a length dimension and a width dimension;

a pair of hinge tubes, each hinge tube (14) secured to said sheet (12) along said width dimension parallel to and spaced from said other hinge tube (14) providing that a central section (12A) and two side sections (12B) are defined;

each side section having a free boundary (16) opposite a boundary secured to said respective hinging tube (14) and opposite a free boundary of said other said side section;

a pair of cords (18), each cord having means (19) for attaching one end of said cord to one corner of said sheet at one end of one of said free boundaries and for attaching another end of said each cord to an opposite end of said one of said free boundaries providing that said pair of cords forms a pair of loop arrangeable to permit a user to hold onto said pair of loops when said kite is in flight;

a center support tube (13) secured to said center section (12A) of said sheet parallel to and intermediate between said hinging tubes (13) and extending from a bottom edge to a top edge of said center section;

a pair of border tubes (11B), one said border tube secured to said central section along said top edge and another border tube secured to said central section along said bottom edge;

a pair of strut tubes (81);

aback panel (83);

a floor (85) being one of:

(i) a floor panel (ii) an array of flor tubes (411);

said pair of border tubes (11B), pair of strut tubes (81), back panel (83), floor (85) operably configured to provide a pouch on a back side of saaid kite opposite said flier;

said central tube baving one end secured to a boundary tube on a top edge oof said central section and another end secured to another boundary edge on a bottom edge of said central section;

a side panel;

a bottom panel;

said boundary tube on said top edge and said boundary tube on said bottom edge and said hinging tubes operably arranged to provide a pouch on a back side of said kite having said bounded by said center section said side panel and said bottom panel.

* * * * *